US005209999A

United States Patent [19]

Tsubota et al.

[11] Patent Number: 5,209,999

[45] Date of Patent: May 11, 1993

[54] ELECTROPHOTOGRAPHIC TOWER FOR NEGATIVE CHARGING

[75] Inventors: Noriaki Tsubota, Himeji; Masahiko Kubo, Yao; Kazuo Fuji, Higashi-osaka; Akihiro Watanabe, Kawai-cho; Yoshihisa Kuramae, Hirakata, all of Japan

[73] Assignee: Mita Industrial Co., Ltd., Osaka, Japan

[21] Appl. No.: 798,746

[22] Filed: Nov. 27, 1991

[30] Foreign Application Priority Data

| | | | |
|---|---|---|---|
| Nov. 28, 1990 | [JP] | Japan | 2-328358 |
| Nov. 28, 1990 | [JP] | Japan | 2-328359 |
| Nov. 28, 1990 | [JP] | Japan | 2-328360 |
| Nov. 28, 1990 | [JP] | Japan | 2-328364 |

[51] Int. Cl.[5] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,401,741 | 8/1983 | Miyakawa et al. | 430/110 |

FOREIGN PATENT DOCUMENTS

| | | | |
|---|---|---|---|
| 34243 | 3/1979 | Japan | 430/110 |
| 211763 | 12/1983 | Japan | 430/110 |
| 68851 | 3/1988 | Japan | 430/110 |
| 276067 | 11/1988 | Japan | 430/110 |

*Primary Examiner*—Roland Martin

*Attorney, Agent, or Firm*—Sherman and Shalloway

[57] ABSTRACT

The electrophotographic toner for negative charging according to the present invention is characterized in that a quaternary ammonium salt having an oxyacid anion is used as a charge-controlling assistant in combination with a charge-controlling agent for negative charging. This quaternary ammonium salt used as the assistant is incompatible with a fixing resin but dispersible therein. Therefore, the toner of the present invention provides a sharp distribution of the charge quantity, and formation of a highly charged toner having no contribution to development or a lowly charged toner causing scattering of the toner can be effectively prevented.

14 Claims, 7 Drawing Sheets

ELECTROPHOTOGRAPHIC TOWER FOR NEGATIVE CHARGING

BACKGROUND OF THE INVENTION (1) Field of the Invention

The present invention relates to an electrophotographic toner for negative charging. More particularly, the present invention relates to an electrophotographic toner for negative charging, which is capable of forming a high-density image without scattering of the toner.

(2) Description of the Related Art

In commercial electrophotographic reproduction or electrophotographic printing, in order to reduce the amount of ozone generated at the charging step, there is ordinarily adopted a process in which an electrostatic image positively charged is formed, and therefore, a toner for negative charging is widely used as the developing toner for developing this electrostatic image.

Recently, development of a laser beam printer or a digital copying machine has advanced, and in this image-forming apparatus, there is adopted an operation of writing a latent image into an organic photosensitive material of the negative charging type by a laser and performing reversal development by a toner for negative charging, and a high quality is also required for the toner negative charging.

The developing toner is generally formed by pulverizing a resin composition comprising a fixing resin, a colorant and a charge-controlling agent as indispensable components into an average particle size of 5 to 15 μm. Naturally, a charge-controlling agent exerting a negative charge-controlling action at the frictional charging is used in case of a toner for negative charging.

In the conventional toner charge-controlling process, the average value of the charge quantity as the entire toner is controlled according to the kind of the charge-controlling agent or the amount added of the charge-controlling agent. However, even if the average value of the charge quantity as the entire toner can be controlled, it is very difficult to strictly control the distribution of the charge quantity in toner particles.

It is known that a plurality of charge-controlling agents having charging performances reverse to each other are incorporated in toner particles. For example, Japanese Unexamined Patent Publication No. 54-34243 discloses a developer for developing an electrostatically charged image, comprising a toner and a carrier, in which the toner is a toner for negative charging, which comprises a dye positively charged by friction with the carrier.

Furthermore, Japanese Unexamined Patent Publication No. 57-196264 discloses an electrically insulating magnetic one-component developer comprising an electrically insulating fixing medium and, dispersed in the fixing medium, a magnetic material powder and a charge-controlling agent, in which the charge-controlling agent comprises a negative or positive charge-controlling agent and a charge-controlling agent having a reverse polarity at a weight ratio of from 1/0.05 to 1/1.5.

In the conventional toner for negative charging, even though the average value of the charge quantity can be maintained at a satisfactory level by adjusting the kind or amount added of the charge-controlling agent, a disadvantage of considerable broadening of the distribution of the charge quantity cannot be eliminated. Namely, a highly charged toner having a much larger charge quantity than the average value, which is not consumed for the development, is inevitably generated at a certain frequency (distribution quantity). Furthermore, a lowly charged toner having a much smaller charge quantity than the average value and causing scattering of the toner is generated at a certain frequency.

Particles of the former highly charged toner are electrically strongly attracted to surfaces of the carrier particles and are present in a hardly separable state, and they extraordinarily inhibit frictional chargeability performances of the carrier particles. Accordingly, even in case of a toner causing no particular problem at the initial stage of the development, with the lapse of the developing time, the proportion of the uncharged or lowly charged toner increases, and such troubles as scattering of the toner, fogging and reduction of the image density are caused.

In the above-mentioned prior art process in which a charge-controlling agent for negative charging is combined with a positively chargeable dye (charge-controlling agent), there can be attained an advantage that the distribution of the charge quantity can be considerably freely shifted to the high charge quantity side or the low charge quantity side, but this process is still insufficient for sharpening the distribution of the charge quantity of the toner and controlling formation of a highly charged toner or a lowly charged toner completely or to a level that can be neglected.

SUMMARY OF THE INVENTION

It is a primary object of the present invention to overcome the above-mentioned defects of the conventional toner for negative charging and provide a toner for negative charging, in which the charge quantity of the toner can be preferably adjusted, the average value of the charge quantity of the toner is arranged within a range optimum for prevention of scattering of the toner and reduction of the image density, the distribution of the charge quantity of the toner is sharp, and there are hardly present a highly charged toner not used for the development and a lowly charged toner causing scattering of the toner.

Another object of the present invention is to provide a toner for negative charging, in which the distribution of the charge quantity of the toner is sharp, rise of the charge is quick at the time of charging, and at the long-time operation the charging characteristics are hardly degraded.

In accordance with the present invention, there is provided an electrophotographic toner for negative charging, comprising a fixing resin, a colorant, a charge-controlling agent for negative charging, and a charge-controlling assistant, wherein the charge-controlling assistant is a positive charge-controlling substance which is incompatible with the fixing resin and has a dispersibility in the fixing resin.

As the positive charge-controlling substance used as the charge-controlling assistant in the present invention, there are preferably used quaternary ammonium salts, especially quaternary ammonium salts containing an oxyacid anion as the anion.

It is preferred that the charge-controlling agent (A) and the charge-controlling assistant (B) be present at an (A)/(B) weight ratio of from 1/0.05 to 1/1, especially from 1/0.1 to 1/0.7, and it also is preferred that the charge-controlling agent and charge-controlling assistant be used in a total amount of 0.5 to 5 parts by weight, especially 2 to 4 parts by weight, per 100 parts by weight of the fixing resin.

DETAILED DESCRIPTION OF THE INVENTION

The present invention is based on the finding that if a positive charge-controlling substance incompatible with a fixing resin but dispersible therein is combined as the charge-controlling assistant with a charge-controlling agent for negative charging, instead of a positively chargeable dye compatible with the fixing resin, conventionally used, the distribution of the charge quantity can be made conspicuously sharper than in the conventional toner, with the result that generation of a highly charged toner not used for the development or a lowly charged toner causing scattering of the toner can be effectively controlled.

Figure 1:
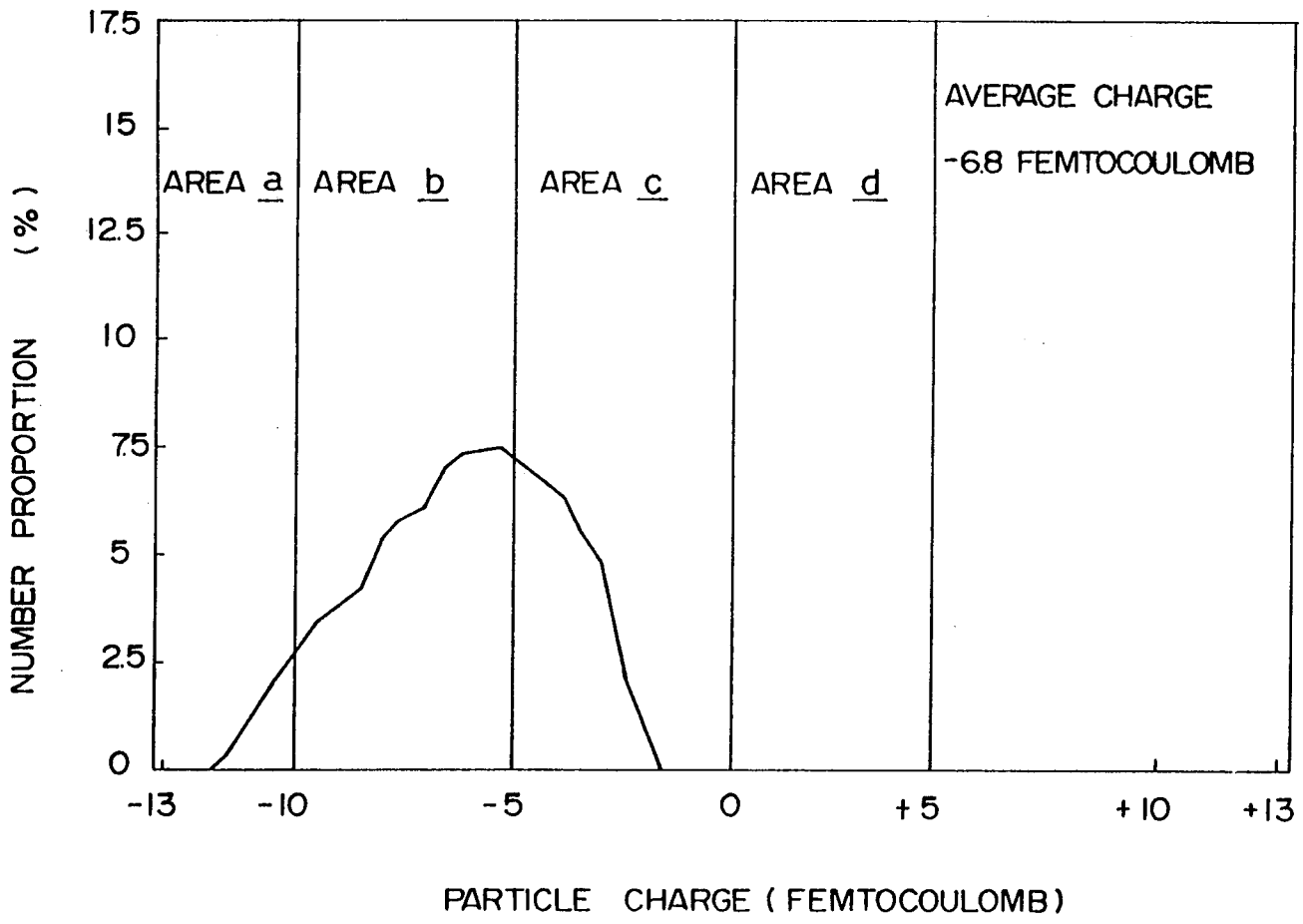
FIG. 1 is a diagram illustrating the distribution of the charge quantity of the toner of the present invention (Example 1).
Figure 2:
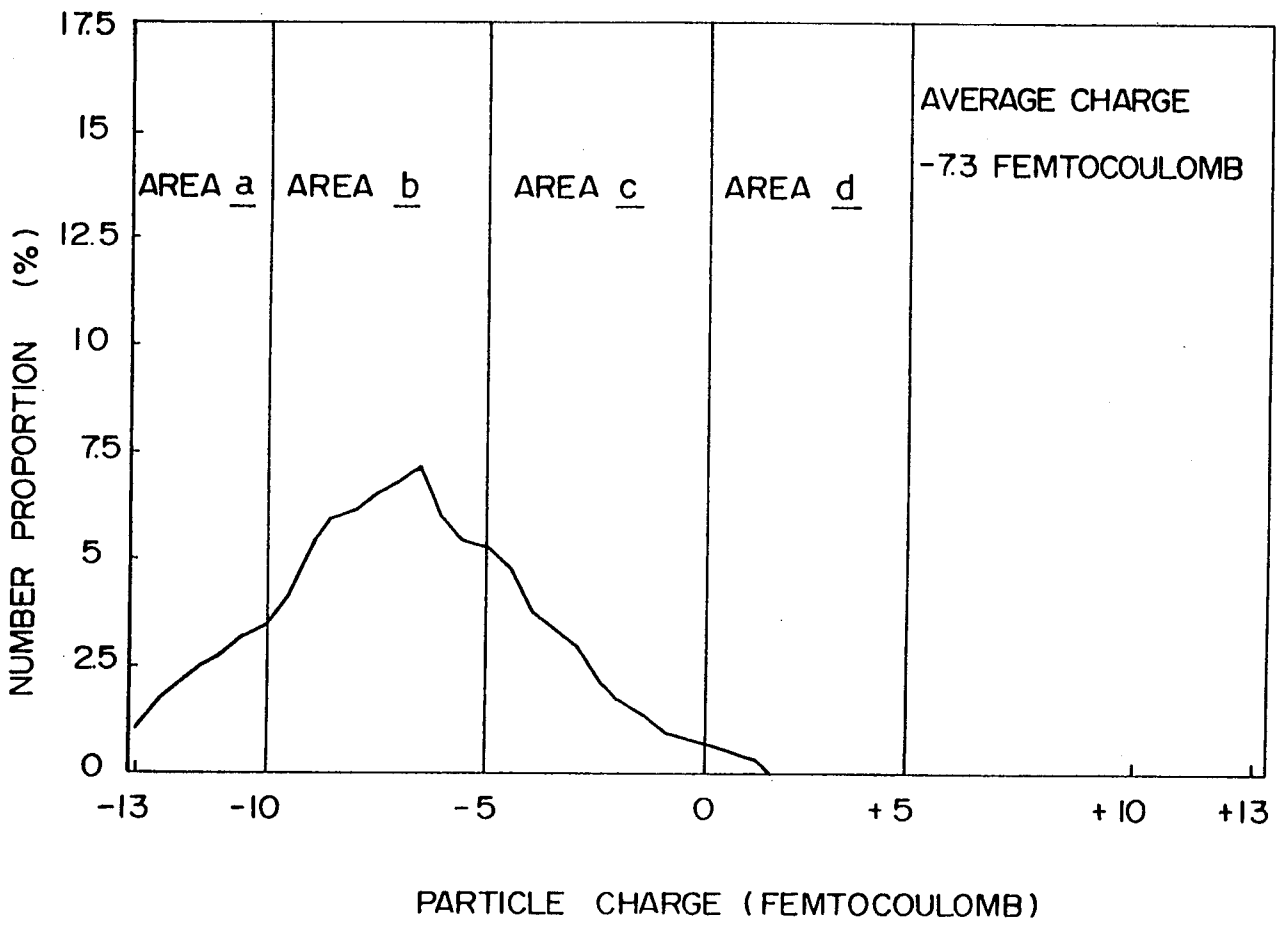
FIG. 2 is a diagram illustrating the distribution of the charge quantity of the toner for negative charging (Comparative Example 1), in which the positive charge-controlling substance is not incorporated.
Figure 3:
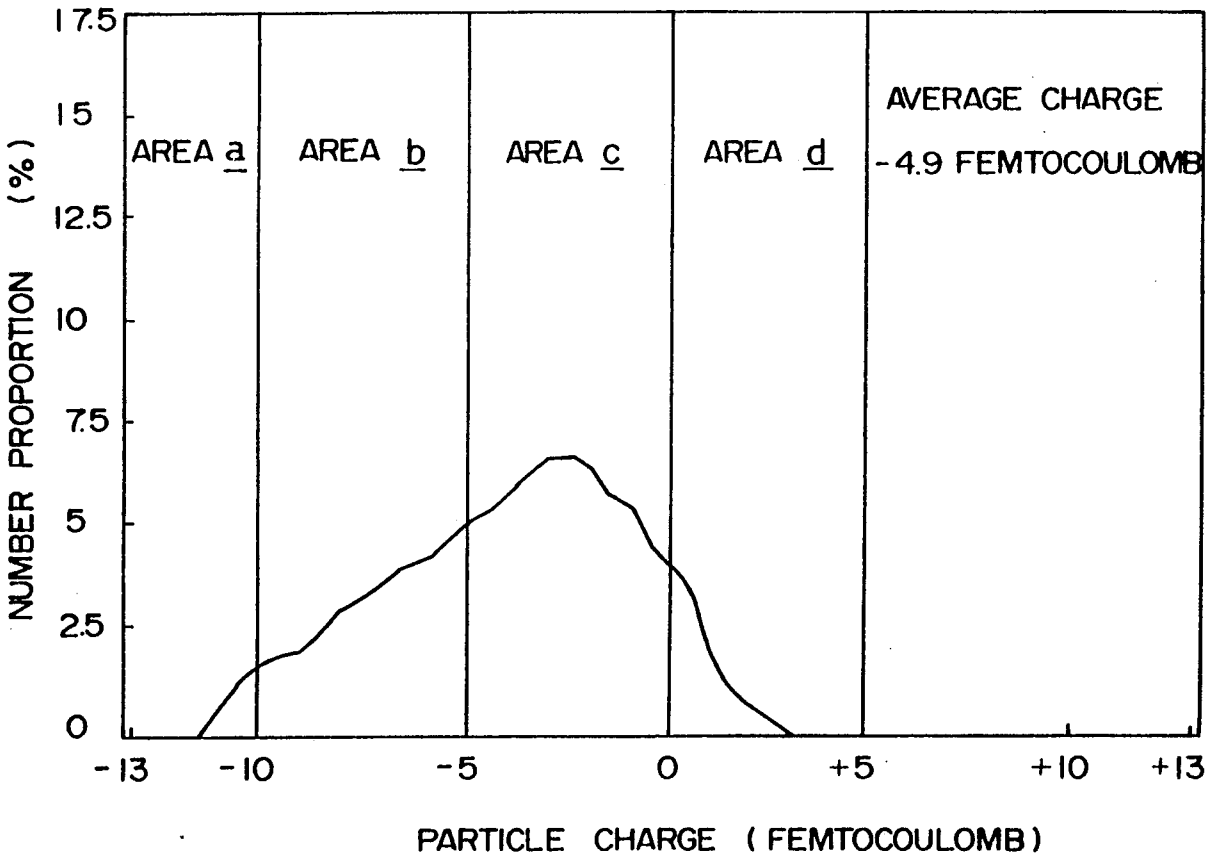
FIG. 3 is a diagram illustrating the distribution of the charge quantity of a toner in which a charge-controlling agent for negative charging and a positively chargeable dye compatible with a fixing resin are incorporated in combination.

These effects of the present invention can be readily understood from FIGS. 1 through 3 showing the distributions of charge quantities of toners.

Figure 4:
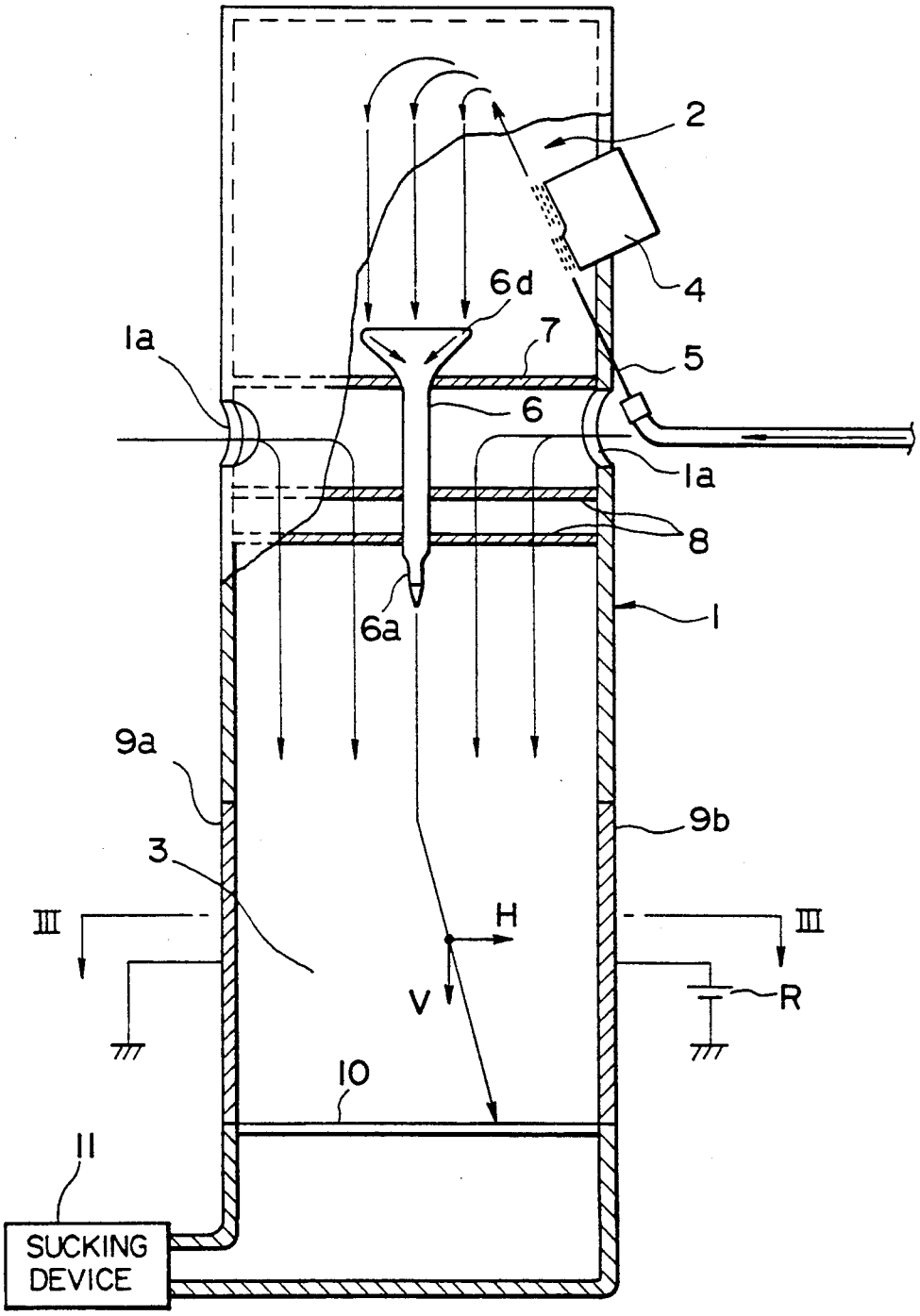
FIG. 4 is a diagram illustrating an apparatus for measuring the charge quantity of the toner.

The distributions of charge quantities shown in FIGS. 1 through 3 are determined by using a charge quantity-measuring apparatus shown in FIG. 4 according to the following method.

MEASUREMENT OF DISTRIBUTION OF CHARGE QUANTITY

The charge quantity-measuring apparatus shown in FIG. 4 comprises a separating portion 2 arranged in a cylindrical housing 1 to separate a toner from a developer, a measuring portion 3 for measuring the distribution of the charge quantity of the separated toner, and a sucking device 11 such as an air pump.

The separating portion 2 is separated from the measuring portion 3 by a partition plate 7. A circulating hole 1*a* for introducing air into the housing 1 is formed on the side wall of the housing 1 slightly below the partition plate 7. An air-rectifying filter 8 is arranged slightly below the circulating hole 1*a*.

In the separating portion 2 compressed air is blown by an air needle 5 to a developer maintained on a magnet 4, whereby only the light toner is blown up and scattered while leaving a carrier attracted magnetically to the magnet 4.

A funnel 6 supported by the partition plate 7 is arranged between the separating portion 2 and the measuring portion 3. A receiving opening 6*d* on the top end of the funnel 6 projects above the partition plate 7, and a dent 6*a* on the lower end pierces through the filter 8 and is exposed to the side of the measuring portion 3.

In the measuring portion 3, by applying a direct current power R to a pair of electrode rods 9*a* and 9*b* embedded in the side wall of the housing 1, a horizontal parallel electric field is formed between the electrode rods 9*a* and 9*b*. Reference numeral 10 represents a filter.

The sucking device 11 forms a main air current flowing from the outside of the housing 1 to the measuring portion 3 through the circulating hole 1*a* and the rectifying filter 8 and also forms an air current for sucking the toner into the funnel 6 above the funnel 6.

In the above-mentioned charge quantity-measuring apparatus, the toner particles separated by the separating portion 2, collected by the funnel 6 and introduced into the measuring portion are vertically dropped while being carried by the air current formed by the sucking device 11 and are allowed to fall on the filter 10 through between the electrode rods 9*a* and 9*b*. Since the toner particles fall down in the horizontal parallel electric field between the electrode rods 9*a* and 9*b* under Coulomb force H corresponding to the charge quantity in the horizontal direction and gravity V in the vertical direction. Accordingly, the toner particles are dispersed on the filter 10 at a position corresponding to the mass or charge quantity thereof. Then, from the distribution of falling positions of the toner particles, the distribution of the charge quantity of the toner is calculated by an image treatment.

The charge quantity distributions curves shown in FIGS. 1, 2 and 3 are those determined according to the above-mentioned method.

In case of toner A where a controlling agent for negative charging alone is used (toner of Comparative Example 1), as shown in FIG. 2, a highly charged toner in area a is present in a large quantity, and a reversely charged toner or an uncharged toner in zone d is contained in a considerable proportion. In case of toner B of the prior art where a positively chargeable dye is combined with a controlling agent for negative charging (toner of Comparative Example 2), as shown in FIG. 3, the average value of the charge quantity can be shifted to a low charge quantity side but the distribution width is not substantially changed from that of toner A, the amount of the highly charged toner is reduced but the highly charged toner is still present, and the proportion of the reversely charged toner or uncharged toner in area d increases. In contrast, in case of toner C of the present invention where a controlling agent for negative charging is combined with a positive charge-controlling assistant in compatible with a fixing resin (toner of Example 1), the quantity of the toner present in appropriate charging areas b and c increases and the width of the distribution of the charge quantity is drastically narrowed, and the quantity of the highly charged toner in area a or the reversely charged or uncharged toner in area d is reduced (is not present in this case).

By using the foregoing toners A, B and C, copying for obtaining 1,000 prints is continuously carried out in a remodelled machine (the developing process is changed to the reversal developing process) of Laser Beam Printer LPX-1 (supplied by Mita Industrial Co.), and the image density (ID), the fog density (FD) of the image and scattering of the toner in the periphery of the developing device are examined. The obtained results are shown in Table 1.

TABLE 1

| Toner | Image Density (ID) | Fog Density (FD) of Image | Toner Scattering (FD) |
|---|---|---|---|
| A | 1.20–1.41 | 0.001–0.009 | conspicuous |
| B | 1.21–1.50 | 0.005–0.010 | very conspicuous |
| C | 1.30–1.32 | below 0.001 | not observed |

From FIGS. 1 through 3 and Table 1, it is understood that the toner of the present invention has such preferred charging characteristics that variation of the image density, formation of fogging of the image and scattering of the toner can be controlled.

In the toner of the present invention, not only at the initial stage of the development, but also when the development is continued for a long time, variation of the image density, occurrence of fogging and scattering of the toner are not caused and a high effect of preventing the deterioration can be attained.

The fact that by using a charge-controlling assistant for positive charging, which is in compatible with the fixing resin, in the toner of the present invention, the distribution of the charge quantity can be sharpened was found as a phenomenon as the result of many experiments. The reason has not been elucidated, but since a positively chargeable dye compatible with the fixing resin has no effect of sharpening the distribution, it is estimated that the dispersion structure in which in a matrix having the controlling agent for negative charging dissolved or dispersed therein, the positively chargeable substance is dispersed in a larger macro particle size will exert a function of reducing numbers of the highly charged toner and the negatively charged toner. In general, one of serious defects of the combination of the positive charge-controlling substance as the assistant with the negative charge-controlling agent is that when a developer comprising this toner and a carrier is stirred in the developing device, rising of the charge is delayed, even though the charge of the toner particles is finally controlled to a negative value. In contrast, in the toner having the composition and dispersion structure specified in the present invention, when the developer is stirred to initiate stirring, rising of the charge is as quick as in case of the negatively chargeable toner comprising a negative charge-controlling agent alone. This is another advantage attained by the present invention.

The negatively chargeable toner of the present invention can be effectively used not only as a toner for forming an ordinary single-color image but also as a toner for forming a so-called full-color image. For example, a full-color image can be formed by lapping a cyan toner, a yellow toner and a magenta toner, but it sometimes happens that the charging characteristics of the respective color toners are changed by a mechanical impact force or heat generated by the stirring operation in the developing device. More specifically, even if the distribution of the charge quantity of each color toner is sharp, it is difficult to maintain this state while continuing the copying operation. Furthermore, if the charging characteristics of each color toner are changed, development of the color toner is not effectively attained, and a desired full-color image can hardly be reproduced. According to the present invention, a sharp distribution of the charge quantity can be effectively maintained over a long period, and the above problem in formation of a full-color image can be effectively eliminated.

CHARGE-CONTROLLING ASSISTANT

The positive charge-controlling substance used as the charge-controlling assistant in the present invention is incompatible with the fixing resin but dispersible therein and has a charge-controlling action of a polarity reverse to that of the charge-controlling agent for negative charging. More specifically, a quaternary ammonium salt is used.

As the quaternary ammonium salt, there is preferably used a compound represented by the following formula:

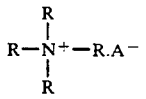

wherein at least one of groups R represents a long-chain alkyl or long-chain alkenyl group having at least 8 carbon toms, especially 8 to 22 carbon atoms, other groups R represent a lower alkyl group, a benzyl group, a long chain alkyl group of a long-chain alkyl group, with the proviso that at least 2 of these groups R represent a lower alkyl group having up to 4 carbon atoms or a benzyl group, and A represents an anion, preferably an oxyacid anion.

As the oxyacid anion, there can be mentioned anions of oxyacids such as orthophosphoric acid and pyrophosphoric acid, molybdic acid, tungstic acid, antimonic acid and bismuthic acid. These quaternary ammonium salts are especially suitable for sharpening the distribution of the charge quantity without delaying rising of charging of the toner.

CHARGE-CONTROLLING AGENT

As the negative charge-controlling agent to be used in combination with the above-mentioned charge-controlling assistant, known negative charge-controlling agents can optionally be used, so far as coloration of the colorant and manifestation of the color hue are not inhibited. Specifically, there can be mentioned 1:1 type and 2:1 type metal complex dyes and metal salts of naphthenic acid, especially, metal complex salt dyes represented by the following formula:

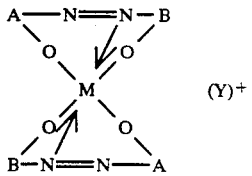

wherein A and B represent residues of diazo and coupling components having a phenolic hydroxyl group at the ortho-position, respectively, M represents a chromium, iron or cobalt metal, and [Y] represents an organic or inorganic cation.

As typical examples, there can be mentioned:

A chromium-containing dye of C.I. Acid Black 123;

C.I. Solvent Black 22;

C.I. Solvent Black 23;

C.I. Solvent Black 28;

C.I. Solvent Black 42; and

C.I Solvent Black 43.

Furthermore, metal-containing monoazo dyes and metal complex compounds of aromatic dicarboxylic acids are preferably used. These negative charge-controlling agents are suitably used for full-color development.

In the present invention, the charge-controlling agent and the charge-controlling assistant are preferably used at a weight ratio of from 1/0.005 to 1/1, especially from 1/0.1 to 1/0.7. It is preferred that the combination of the charge-controlling agent and charge-controlling assistant be present in an amount of 1 to 5 parts by weight, especially 2 to 4 parts by weight, per 100 parts by weight of the fixing resin.

FIXING RESIN

A known resin which is not compatible with the charge-controlling assistant but is capable of dispersing the charge-controlling assistant therein is used as the fixing resin. Since the fixing resin negatively charges the toner, it is preferred that the fixing resin should have a tendency to be negatively charged. For example, a styrene resin, an acrylic resin and a styrene-acrylic resin are generally used.

As the styrene monomer constituting the fixing resin, there can be mentioned monomers represented by the following formula:

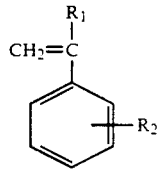

wherein $R_1$ represents a hydrogen atoms, a lower alkyl group (having up to 4 carbon atoms) or a halogen atom, $R_2$ represents a hydrogen atom or a substituent such as a lower alkyl group or a halogen atom, such as styrene, vinyltoluene, α-methylstyrene, α-chlorostyrene and vinylxylene, and vinylnaphthalene. Of these monomers, styrene is preferably used.

As the acrylic monomer, there can be mentioned monomers represented by the following formula:

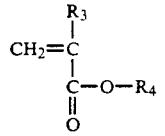

wherein $R_3$ represents a hydrogen atom or a lower alkyl group, and $R_4$ represents a hydrogen atom or a substituted or unsubstituted alkyl group having up to 18 carbon atoms, such as ethyl acrylate, methyl methacrylate, butyl acrylate, butyl methacrylate, 2-ethylhexyl acrylate, 2-ethylhexyl methacrylate, acrylic acid and methacrylic acid. As the acrylic monomer, there can be used other ethylenically unsaturated carboxylic acids and anhydrides thereof, such as maleic anhydride, crotonic acid and itaconic acid.

A styrene acrylic copolymer resin is one of preferred fixing resins, and the weight ratio A/B of the styrene monomer (A) to the acrylic monomer (B) is preferably from 50/50 to 90/10, especially preferably from 60/40 to 85/15. Preferably, the acid value of the resin used is 0 to 25. From the viewpoint of the fixing property, it is preferred that the resin should have a class transition temperature (Tg) of 50° to 75° C.

As the colorant to be incorporated into the binder resin, there can be used at least one member selected from the group consisting of inorganic and organic pigments and dyes, for example, carbon blacks such as furnace black and channel black, iron blacks such as triiron tetroxide, rutile titanium dioxide, anatase titanium dioxide, Phthalocyanine Blue, Phthalocyanine Green, cadmium yellow, molybdenum orange, Pyrazolone Red and Fast Violet B.

In the case where the toner of the present invention is used as the yellow toner for full-color development, for example, there are preferably used benzidine pigments such as C.I. Pigment Yellow 13 (Benzidine Yellow GR), C.I. Pigment Yellow 14 (Vulcan Fast Yellow G), C.I. Pigment Yellow 17, C.I. Pigment Yellow 55, C.I. Pigment Yellow 12 and C.I. Pigment Yellow 83. In this case, a yellow colorant such as chrome yellow, titanium yellow or quinoline yellow lake can be used in addition to the benzidine pigment according to need.

In the case where the toner of the present invention is used as the magenta toner full-color development, quinacridone pigments such as C.I. Pigment Red 122 (Quinacridone Magneta), C.I. Pigment Red 192, C.I. Pigment Red 209 and C.I. Pigment Violet 19 (Quinacridone Violet) are preferably used.

In the case where the toner of the present invention is used as the cyan toner for full-color development, copper phthalocyanine pigments such as C.I. Pigment Blue 15 (Phthalocyanine Blue), C.I. Pigment 16 (Heliogen Blue G) and C.I. Pigment Blue 17 (Fast Sky Blue) are preferably used.

The colorant is generally used in an amount of 2 to 15 parts by weight, preferably 3 to 10 parts by weight, per 100 parts by weight of the resin.

TONER

The particle size of toner particles is such that the volume-based median diameter measured by a Coulter Counter is 5 to 15 μm, especially 7 to 12 μm. The particles can have an indeterminate shape formed by melt-mixing and pulverization or a spherical shape formed by dispersion or suspension polymerization.

The toner of the present invention is combined with a known magnetic carrier and used as a two-component magnetic developer to exert excellent charging characteristics.

As the magnetic carrier, there can be used a ferrite carrier and an iron powder carrier. The carrier can be used in an uncoated stated or resin-coated stated. In general, a ferrite carrier is preferably used.

As the ferrite, there have been used sintered ferrite particles composed of at least one member selected from the group consisting of zinc iron oxide ($ZnFe_2O_4$), Yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganes iron oxide ($MnFe_2O_4$) and lanthanum iron oxide ($LaFeO_3$). Especially, soft ferrites containing at least one member, preferably at least two members, selected from the group consisting of Cu, Zn, Mg, Mn and Ni, for example, a copper/zinc-/magnesium ferrite, can be used.

As the coating resin for magnetic carriers, there are known an acrylic resin, a styrene resin, a silicone resin, a fluorine resin and an amino-modified resin. A resin that controls indirectly the toner charge to a negative level by controlling the charge of the resin-coated magnetic carrier to a positive level is preferably used. Of course, in the present invention, even if this carrier-coating resin is not present, control of the charge can be accomplished effectively and assuredly.

It is preferred that the saturation magnetization of the carrier be 40 to 75 emu/g, especially 45 to 70 emug. A ferrite carrier satisfying the above requirement, especially a ferrite carrier having a spherical shape, is preferably used. It is preferred that the particle size of the ferrite carrier be 20 to 140 μm, especially 50 to 100 μm.

The mixing ratio of the toner and the magnetic carrier depends on the physical properties of the toner and the magnetic carrier, but it is preferred that the mixing weight ratio be in the range of from 1/99 to 10/90, especially from 2/98 to 5/95.

It also is preferred that the resistivity of the developer as a whole be $5\times10^9$ to $5\times10^{12}$ Ω-cm, especially $5\times10^9$ to $5\times10^{11}$ Ω-cm.

At the development of an electrostatic image, the above-mentioned toner and magnetic carrier are mixed, a magnetic brush having a predetermined length is formed on a developing sleeve having a magnet roll arranged therein, and the magnetic brush is brought into sliding contact with a photosensitive material having the electrostatic image, or the magnetic brush is brought into close proximity to the electrostatic image-holding photosensitive material in a field to which a vibrating electric field is applied.

EXAMPLES

The present invention will now be described in detail with reference to the following examples that by no means limit the scope of the invention.

EXAMPLE 1

By a twin-screw kneader, 100 parts by weight of a styrene/acrylic copolymer as the fixing resin, 8 parts by weight of carbon black as the colorant, 1.5 parts by weight of low-molecular-weight polypropylene as the offset-preventing agent, 2 parts by weight of an aromatic carboxylic acid/aluminum complex as the charge-controlling agent for negative charging and 0.5 part by weight of a quaternary ammonium salt represented by the following formula:

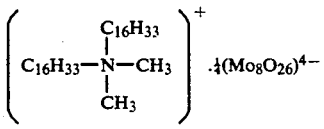

as the charge-controlling assistant incompatible with the styrene/acrylic copolymer were melt-kneaded, and the melt-kneaded mixture was cooled, pulverized and sieved to obtain a toner having an average particle size of 11 μm. The toner was mixed and stirred with a resin-coated ferrite carrier having an average particle size of 85 μm at a toner concentration of 4.5% to form a developer. The distribution of the charge quantity was measured by the toner charge quantity-measuring apparatus shown in FIG. 4. The obtained results are shown in FIG. 1.

By using a remodelled machine (the developing process was changed to the reversal developing process) of Laser Beam Printer LPX-1 (supplied by Mita Industrial Co.) having an organic photosensitive material for negative charging mounted thereon (surface potential of photosensitive material: −700 V, developing bias voltage: −500 V), the above-mentioned developer was subjected to the continuous copying test for forming 1,000 prints. Reduction of the image density or occurrence of fogging of the image was not observed, and scattering of the toner was not caused.

The obtained results are shown in Table 1.

EXAMPLE 2

A toner having an average particle size of 11 um was prepared in the same manner as described in Example 1 except that 0.5 part by weight of a quaternary ammonium salt represented by the following formula:

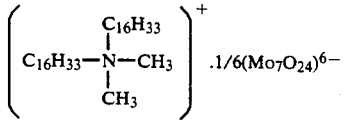

was used as the charge-controlling assistant.

Then, in the same manner as described in Example 1, a developer was formed and 1,000 prints were continuously formed. As in Example 1, a good image was obtained, and scattering of the toner in the machine was not caused. Furthermore, the distribution of the charge quantity of the toner was as sharp as in Example 1.

COMPARATIVE EXAMPLE 1

A toner was prepared in the same manner as described in Example 1 except that the charge-controlling assistant was not used. The distribution of the charge quantity of the toner was measured in the same manner as described in Example 1. The obtained results are shown in FIG. 2. Furthermore, 1,000 prints were continuously formed in the same manner as described in Example 1. The image density was unstable and dropping of the image density often occurred. Fogging of the image or scattering of the toner was sometimes caused.

COMPARATIVE EXAMPLE 2

A toner was prepared in the same manner as described in Example 1 except that 2 parts by weight of Solvent Yellow 56, compatible with the fixing resin, was used instead of the charge-controlling assistant used in Example 1. The distribution of the charge quantity of the toner was measured in the same manner as described in Example 1. The obtained results are shown in FIG. 3. Furthermore, 1,000 prints were continuously formed in the same manner as described in Example 1. Fogging of the image and scattering of the toner were conspicuous. The image density was satisfactory to some extent, but the density often became uneven.

COMPARATIVE EXAMPLE 3

A toner was prepared in the same manner as described in Example 1 except that 2 parts by weight of Basic Blue 26, compatible with the fixing resin, was used instead of the charge-controlling assistant used in Example 1. The distribution of the charge quantity of the toner was measured in the same manner as described in Example 1. The obtained results were similar to those shown in FIG. 3. Furthermore, 1,000 prints were continuously formed in the same manner as described in Example 1. Fogging of the image and scattering of the toner were conspicuous. The image density was satisfactory to some extent, but the density often became uneven.

EXAMPLE 3

A toner (yellow toner) having an average particle size of 11 μm was prepared in the same manner as described in Example 1 by using 100 parts by a styrene/acrylic copolymer as the fixing resin, 5 parts by weight of C.I. Pigment Yellow 17 as the colorant, 1.5 parts by weight of low-molecular-weight polypropylene as the offset-preventing agent, 2 parts by weight of an aromatic dicarboxylic acid/aluminum complex as the charge-controlling agent for negative charging and 0.5 part by weight of the quaternary ammonium salt used in Example 1.

Figure 5:
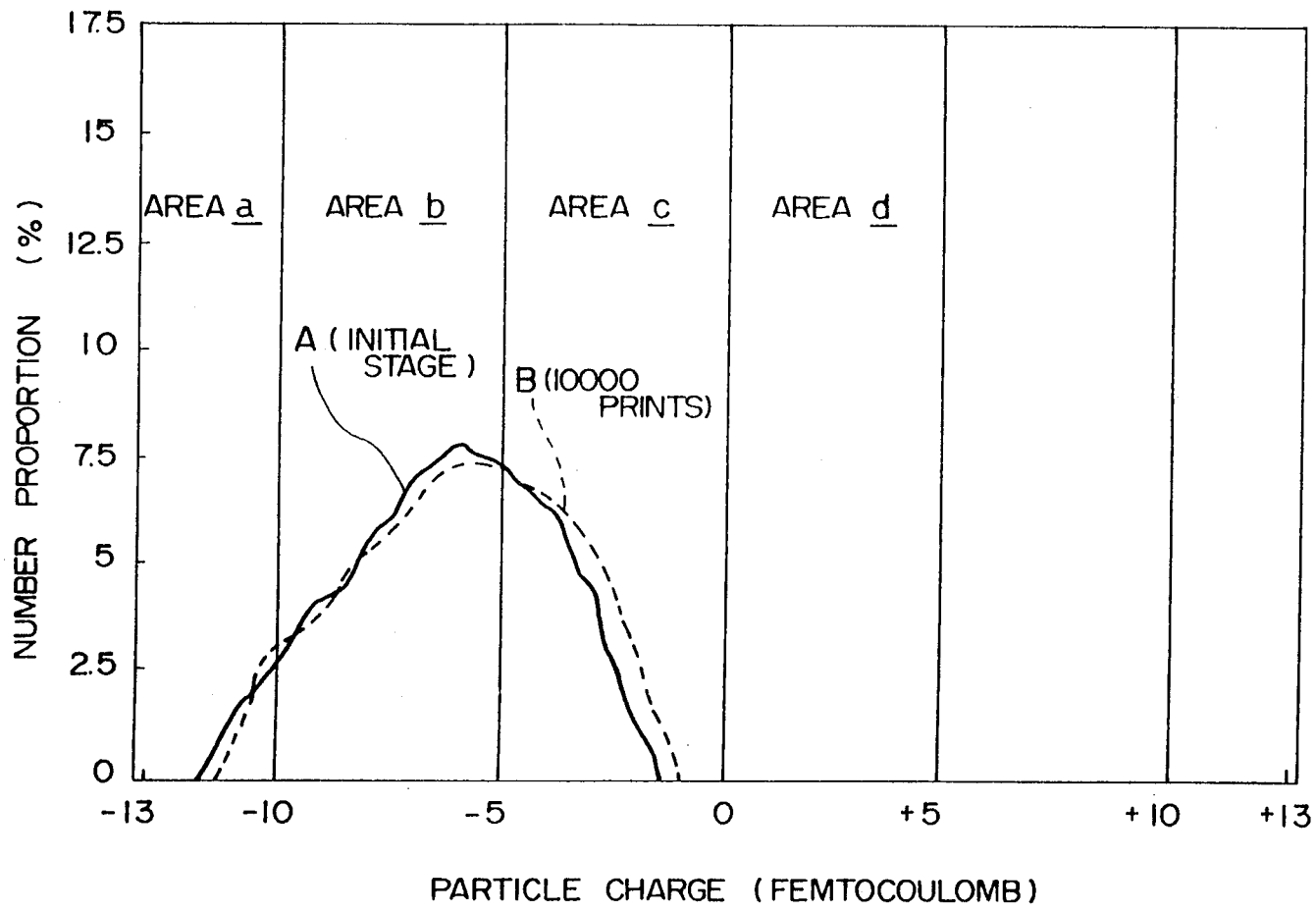
FIG. 5 is a diagram illustrating the distribution (curve A) of the initial charge quantity and the distribution (curve B) of the charge quantity after formation of 10,000 copies, observed with respect to the toner of Example 3.

Then, a developer was prepared in the same manner as described in Example 1, and the distribution of the charge quantity was measured by using the apparatus shown in FIG. 4. A sharp distribution shown in curve A in FIG. 5 was observed.

Furthermore, in the same manner as described in Example 1, 1,000 prints were continuously formed and the image characteristics were observed. A good image having no scattering of the toner was obtained.

Still further, 10,000 prints were continuously formed and the distribution of the charge quantity of the toner was measured. The obtained distribution curve (curve B in FIG. 5) was as sharp as the curve A of the initial distribution of the charge quantity.

EXAMPLE 4

A toner (yellow toner) was prepared in the same manner as described in Example 3 except that 5 parts by weight of C.I. Pigment Yellow 13 was used as the colorant and 0.5 part by weight of the quaternary ammonium salt used in Example 2 was used as the charge-controlling assistant.

The distribution of the charge quantity was measured in the same manner as described in Example 1. The obtained distribution curve was sharp and similar to the curve A in FIG. 5.

Furthermore, in the same manner as described in Example 3, the image characteristics were observed after 1,000 prints were continuously formed, and the distribution of the charge quantity was measured after 10,000 prints were continuously formed. Scattering of the toner was not caused and a good image was obtained, and the distribution of the charge quantity was substantially as sharp as in the initial stage.

COMPARATIVE EXAMPLE 4

A toner was prepared in the same manner as described in Example 3 except that 0.5 part by weight of C.I. Solvent Yellow 56 compatible with the fixing resin was used instead of the charge-controlling assistant used in Example 3. The distribution of the charge quantity of the toner was measured in the same manner as described in Example 1. A board distribution similar to that shown in FIG. 3 was observed.

When 1,000 prints were continuously formed, fogging of the image and scattering of the toner were conspicuous. The image density was satisfactory to some extent, but density unevenness was sometimes caused.

EXAMPLE 5

Figure 6:
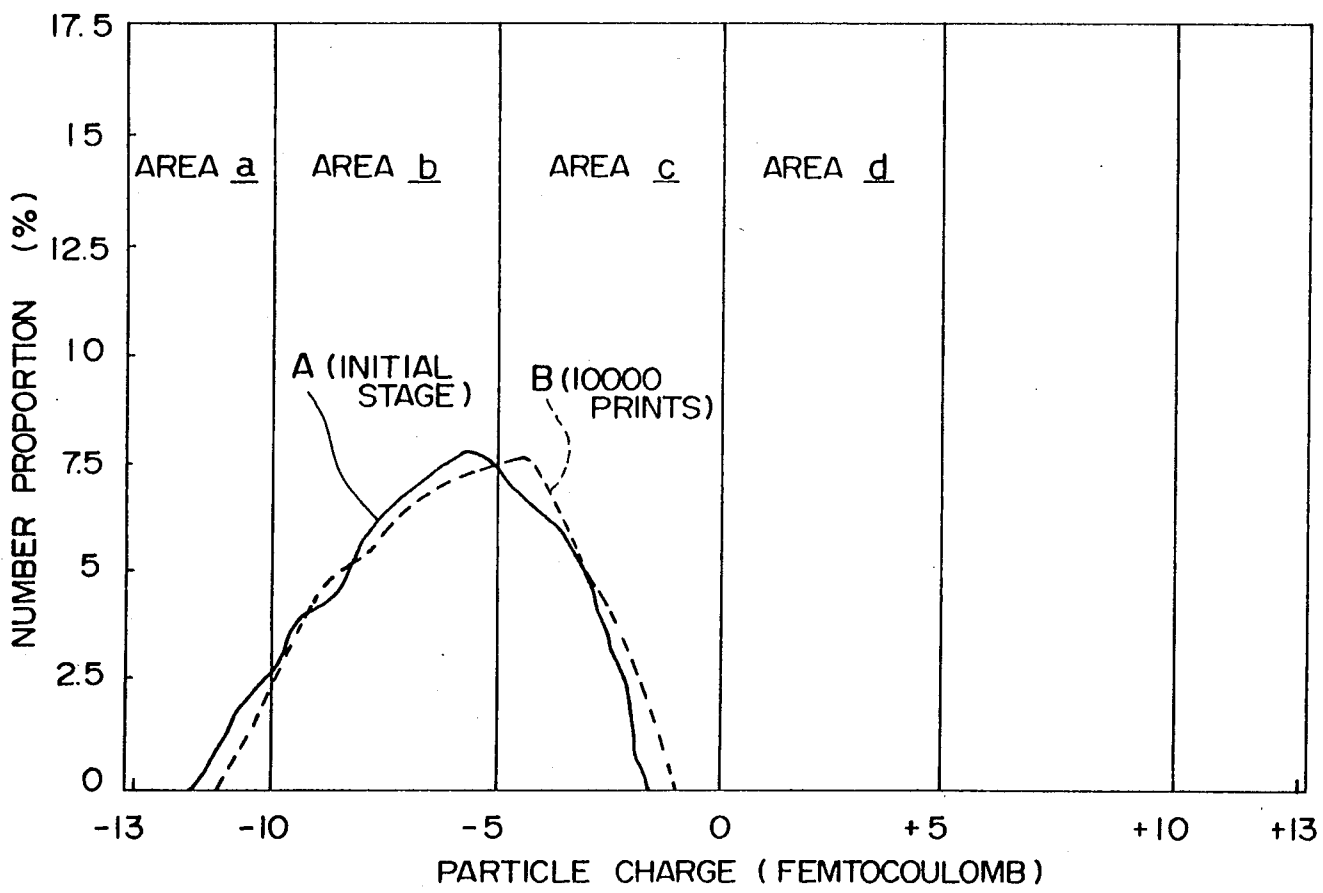
FIG. 6 is a diagram illustrating the distribution (curve A) of the initial charge quantity and the distribution (curve B) of the charge quantity after formation of 10,000 copies, observed with respect to the toner of Example 5.

A toner (magenta toner) was prepared in the same manner as described in Example 3 except that 5 parts by weight of C.I. Pigment Red 122 was used as the colorant. A sharp distribution shown in the curve A in FIG. 6 was obtained.

In the same manner as described in Example 3, 1,000 prints were continuously formed and the image characteristics were observed. A good image was obtained without scattering of the toner. Then, 10,000 prints were continuously formed and the distribution of the charge quantity was measured. As shown by the curve B in FIG. 6, the obtained distribution was sharp and was not substantially different from the initial distribution of the charge quantity.

EXAMPLE 6

A toner (magenta toner) was prepared in the same manner as described in Example 4 except that 5 parts by weight of C.I. Pigment Red 122 was used as the colorant. A sharp distribution similar to that shown in the curve A in FIG. 6 was obtained.

In the same manner as described in Example 4, 1,000 prints were continuously formed and the image characteristics were observed. A good image was obtained without scattering of the toner. Then, 10,000 prints were continuously formed and the distribution of the charge quantity was measured. The obtained distribution was sharp and was not substantially different from the initial distribution of the charge quantity.

EXAMPLE 7

Figure 7:
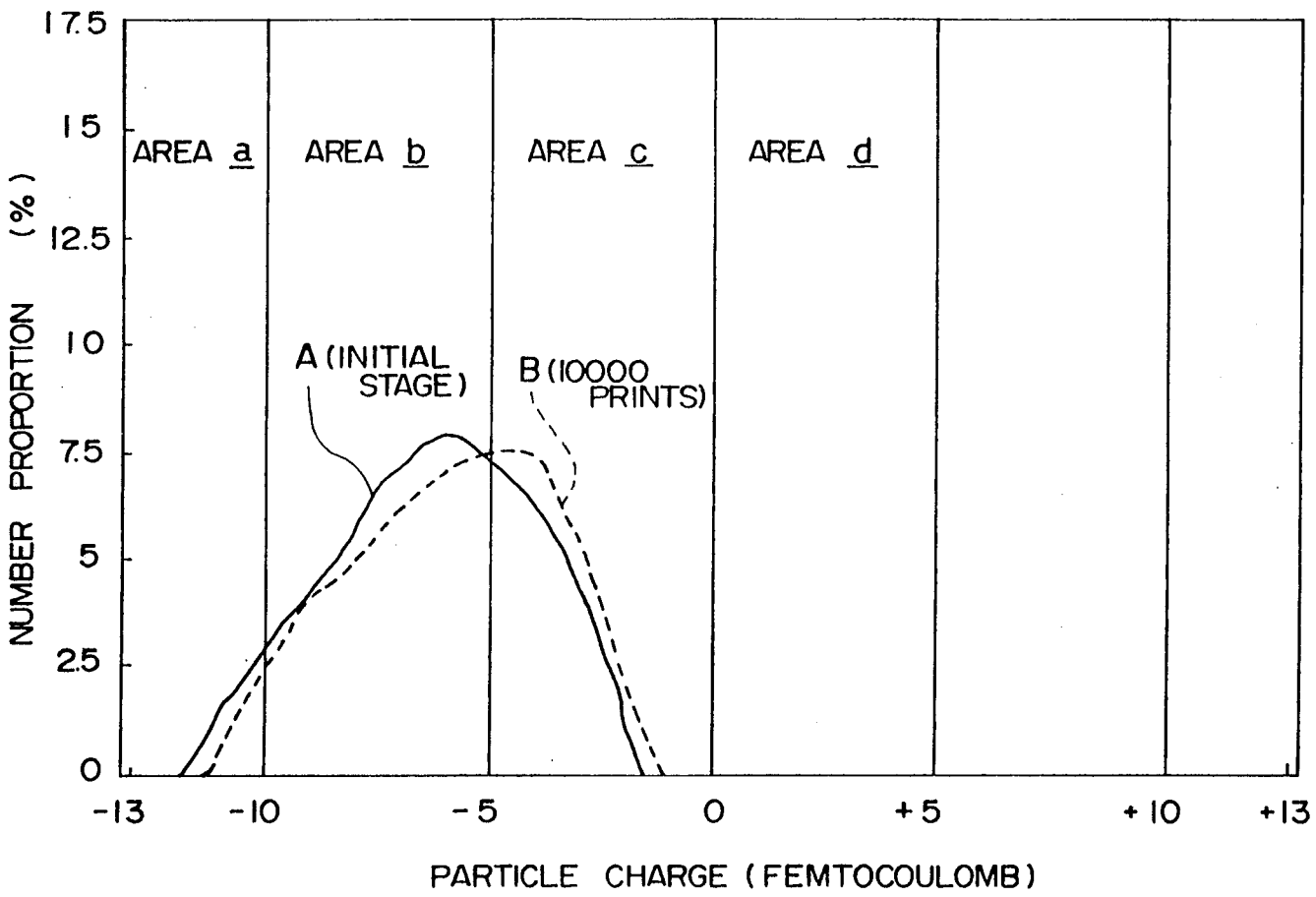
FIG. 7 is a diagram illustrating the distribution (curve A) of the initial charge quantity and the distribution (curve B) of the charge quantity after formation of 10,000 copies, observed with respect to the toner of Example 7.

A toner (cyan toner) was prepared in the same manner as described in Example 3 except that 5 parts by weight of C.I. Pigment Blue 15 was used as the colorant. A sharp distribution shown in the curve A in FIG. 7 was obtained.

In the same manner as described in Example 3, 1,000 prints were continuously formed and the image characteristics were observed. A good image was obtained without scattering of the toner. Then, 10,000 prints were continuously formed and the distribution of the charge quantity was measured. As shown by the curve B in FIG. 7, the obtained distribution was sharp and was not substantially different from the initial distribution (curve A) of the charge quantity.

EXAMPLE 8

A toner (cyan toner) was prepared in the same manner as described in Example 4 except that 5 parts by weight of C.I. Pigment Blue 15 was used as the colorant. A sharp distribution similar to that shown in the curve A in FIG. 7 was obtained.

In the same manner as described in Example 4, 1,000 prints were continuously formed and the image characteristics were observed. A good image was obtained without scattering of the toner. Then, 10,000 prints were continuously formed and the distribution of the charge quantity was measured. The obtained distribution was sharp and was not substantially different from the initial distribution of the charge quantity.

We claim:

1. An electrophotographic toner for negative charging, comprising a fixing resin, a colorant, a charge-controlling agent for negative charging, and a charge-controlling assistant, wherein the charge-controlling assistant is a positive charge-controlling substance which is incompatible with the fixing resin and has a dispersibility in the fixing resin, said charge-controlling assistant being a compound represented by the formula

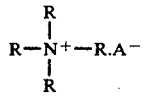

wherein at least one of groups R represents a long chain alkyl or long-chain alkenyl group having at least 8 carbon atoms, other groups R represent a lower alkyl group, a benzyl group, a long-chain alkyl group or a long-chain alkenyl group, with the proviso that at least 2 of these groups R represent a lower alkyl group having up to 4 carbon atoms or a benzyl group, and A represents an oxyacid anion.

2. A toner as set forth in claim 1, wherein the charge-controlling agent and the charge-controlling assistant are present at a weight ratio of from 1/0.05 to 1/1, and are used in a total amount of 0.5 to 5 parts by weight per 100 parts by weight of the fixing resin.

3. A yellow toner as set forth in claim 1, wherein the colorant is a benzidine pigment.

4. A magenta toner as set forth in claim 1, wherein the colorant is a quinacridone pigment.

5. A cyan toner as set forth in claim 1, wherein the colorant is a copper-phthalocyanine pigment.

6. A toner as set forth in claim 1, wherein said long-chain alkyl group or said long-chain alkenyl group has 8 to 22 carbon atoms.

7. A toner as set forth in claim 2, wherein the charge-controlling agent and the charge-controlling assistant are present at a weight ratio of from 1/0.1 to 1/0.7 and are used in a total amount of 2 to 4 parts by weight per 100 parts by weight of the fixing resin.

8. A toner as set forth in claim 1, wherein the fixing resin comprises a styrene monomer, an acrylic monomer or a mixture thereof.

9. A toner as set forth in claim 8, wherein said styrene monomer is represented by the formula

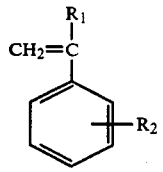

wherein $R_1$ represents a hydrogen atom, a lower alkyl group having up to 4 carbon atoms or a halogen atom, and $R_2$ represents a hydrogen atom, a lower alkyl group or a halogen atom.

10. A toner as set forth in claim 8, wherein said acrylic monomer is represented by the formula

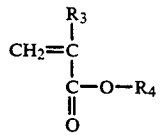

wherein $R_3$ represents a hydrogen atom or a lower alkyl group, and $R_4$ represents a hydrogen atom or a substituted or unsubstituted alkyl group having a up to 18 carbon atoms.

11. A toner as set forth in claim 8, wherein said fixing resin is a styrene-acrylic copolymer resin wherein the weight ratio of styrene monomer to acrylic monomer is from 50/50 to 90/10.

12. A toner as set forth in claim 11, wherein the weighty ratio of styrene monomer to acrylic monomer is from 60/40 to 85/15.

13. A toner as set forth in claim 1, having a volume-based median particle diameter of 5 to 15 μm.

14. A toner as set forth in claim 13, wherein said particle diameter is 7 to 12 μm.

* * * * *

UNITED STATES PATENT AND TRADEMARK OFFICE

CERTIFICATE OF CORRECTION

PATENT NO. : 5,209,999

DATED : May 11, 1993

INVENTOR(S) : Noriaki Tsubota, et al.

It is certified that error appears in the above-identified patent and that said Letters Patent is hereby corrected as shown below:

On the cover page, item [54]:

delete "TOWER" and insert --TONER--.

Column 1, line 2, delete "TOWER" and insert --TONER--.

Signed and Sealed this

Eleventh Day of January, 1994

Bruce Lehman

*Attest:*

BRUCE LEHMAN

*Attesting Officer*

*Commissioner of Patents and Trademarks*